US011473158B2

(12) United States Patent
Takanezawa et al.

(10) Patent No.: US 11,473,158 B2
(45) Date of Patent: *Oct. 18, 2022

(54) METHOD FOR MANUFACTURING ALLOY RIBBON PIECE

(71) Applicant: TOYOTA JIDOSHA KABUSHIKI KAISHA, Toyota (JP)

(72) Inventors: Yu Takanezawa, Nisshin (JP); Osamu Yamashita, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 55 days.

This patent is subject to a terminal disclaimer.

(21) Appl. No.: 16/808,975

(22) Filed: Mar. 4, 2020

(65) Prior Publication Data

US 2020/0283861 A1 Sep. 10, 2020

(30) Foreign Application Priority Data

Mar. 5, 2019 (JP) ..... JP2019-039287

(51) Int. Cl.
*C21D 1/34* (2006.01)
*C22C 45/00* (2006.01)

(52) U.S. Cl.
CPC ..... *C21D 1/34* (2013.01); *C21D 2201/03* (2013.01); *C22C 45/008* (2013.01)

(58) Field of Classification Search
None
See application file for complete search history.

(56) References Cited

U.S. PATENT DOCUMENTS 4,265,684 A * 5/1981 Boll ..... C21D 6/00 148/121
7,540,899 B1 * 6/2009 Johnson ..... A61L 27/04 148/561

(Continued)

FOREIGN PATENT DOCUMENTS

JP 2017-141508 A 8/2017
JP 2018-125475 A 8/2018

OTHER PUBLICATIONS

Non Final Office Action dated Aug. 24, 2021, issued by the U.S. Patent and Trademark Office in U.S. Appl. No. 16/807,935.

(Continued)

*Primary Examiner* — George Wyszomierski
(74) *Attorney, Agent, or Firm* — Sughrue Mion, PLLC

(57) ABSTRACT

A method for manufacturing a nanocrystalline alloy ribbon piece with high productivity is provided. The method according to the present disclosure is a method for manufacturing an alloy ribbon piece obtained by crystallizing an amorphous alloy ribbon piece, and includes: preparing the amorphous alloy ribbon piece; sequentially heating the ribbon piece from one end to an intermediate position toward another end to a temperature range equal to or more than a crystallization starting temperature, and stopping the heating when heating the ribbon piece up to the intermediate position; and sequentially heating the ribbon piece from the other end to a position immediately before the intermediate position to the temperature range. In the sequentially heating the ribbon piece from the other end, the ribbon piece is heated up to the position immediately before the intermediate position after the heating is stopped in sequentially heating the ribbon piece from the one end.

3 Claims, 8 Drawing Sheets

(56) References Cited

U.S. PATENT DOCUMENTS

| | | | | |
|---|---|---|---|---|
| 2014/0007989 | A1* | 1/2014 | Prest | C22C 1/00 148/537 |
| 2017/0229237 | A1 | 8/2017 | Makino et al. | |
| 2020/0283860 | A1 | 9/2020 | Yamashita et al. | |

OTHER PUBLICATIONS

Final Office Action dated Jan. 31, 2022 from the U.S. Patent and Trademark Office in U.S. Appl. No. 16/807,935.
Notice of Allowance dated Jun. 2, 2022, issued in U.S. Appl. No. 16/807,935.
Supplemental Notice of Allowability dated Jul. 14, 2022, issued in U.S. Appl. No. 16/807,935.

* cited by examiner

METHOD FOR MANUFACTURING ALLOY RIBBON PIECE

CROSS REFERENCE TO RELATED APPLICATIONS

The present application claims priority from Japanese patent application JP 2019-039287 filed on Mar. 5, 2019, the content of which is hereby incorporated by reference into this application.

BACKGROUND

Technical Field

The present disclosure relates to a method for manufacturing an alloy ribbon piece obtained by crystallizing an amorphous alloy ribbon piece.

Description of Related

Conventionally, since an amorphous alloy ribbon piece is a soft magnetic material, the amorphous alloy ribbon pieces punched from a continuous amorphous alloy ribbon manufactured by a method such as a single roll method and a twin roll method are used for, for example, a motor core. Since a nanocrystalline alloy ribbon piece obtained by crystallizing the amorphous alloy ribbon piece is a soft magnetic material that can provide a high saturation magnetic flux density and a low coercivity at the same time, recently, the nanocrystalline alloy ribbon piece has been used for those cores.

When the nanocrystalline alloy ribbon piece is manufactured through crystallization of the amorphous alloy ribbon piece by heating the amorphous alloy ribbon piece to a temperature equal to or more than a crystallization starting temperature, generated heat due to crystallization of the amorphous alloy ribbon piece causes an excessive temperature rise of the alloy ribbon piece, and as a result, coarse crystal grains and precipitation of a compound phase occur to possibly deteriorate soft magnetic properties.

As a method for dealing with such a problem, for example, JP 2017-141508 A discloses a method for absorbing the generated heat due to crystallization by plates on both ends in a method for crystallizing an amorphous alloy ribbon piece by heating with the plates between which the amorphous alloy ribbon piece is sandwiched.

For example, JP 2018-125475 A discloses a method for crystallizing an amorphous alloy ribbon piece by raising temperature of the amorphous alloy ribbon piece in a furnace at a high speed. With this method, it is considered that uniformly heating each position of the amorphous alloy ribbon piece can suppress occurrence of the excessive temperature rise of the alloy ribbon piece caused by the generated heat due to crystallization.

SUMMARY

However, as the method disclosed in JP 2017-141508 A, with the method to reduce the excessive temperature rise to suppress the coarse crystal grains and the like by performing the operation to absorb the generated heat due to crystallization using an additionally prepared endothermic member, the nanocrystalline alloy ribbon piece cannot be manufactured with high productivity.

As the method disclosed in JP 2018-125475 A, with the method to raise the temperature of the amorphous alloy ribbon piece in the furnace, it is actually difficult to uniformly heat each position to crystallize the amorphous alloy ribbon piece. Therefore, heat accumulation caused by the generated heat due to crystallization occurs on the alloy ribbon piece to cause the excessive temperature rise, thus resulted in the deterioration of the soft magnetic properties in some cases.

The present disclosure has been made in view of such an aspect, and provides a method for manufacturing an alloy ribbon piece capable of manufacturing a nanocrystalline alloy ribbon piece obtained by crystallizing an amorphous alloy ribbon piece with high productivity.

To solve the above-described problem, a method for manufacturing an alloy ribbon piece according to the present disclosure is a method for manufacturing an alloy ribbon piece obtained by crystallizing an amorphous alloy ribbon piece. The method includes: a preparation step of preparing the amorphous alloy ribbon piece; a first heat treatment step of sequentially heating the amorphous alloy ribbon piece from one end to an intermediate position toward another end to a temperature range equal to or more than a crystallization starting temperature, and stopping the heating when heating the amorphous alloy ribbon piece up to the intermediate position to the temperature range equal to or more than the crystallization starting temperature; and a second heat treatment step of sequentially heating the amorphous alloy ribbon piece from the other end to a position immediately before the intermediate position to the temperature range equal to or more than the crystallization starting temperature. In the second heat treatment step, the amorphous alloy ribbon piece is heated up to the position immediately before the intermediate position to the temperature range equal to or more than the crystallization starting temperature after the heating is stopped in the first heat treatment step.

Effect

The present disclosure ensures manufacturing the nanocrystalline alloy ribbon piece obtained by crystallizing the amorphous alloy ribbon piece with high productivity.

DETAILED DESCRIPTION OF THE EMBODIMENTS

The following describes an embodiment of a method for manufacturing an alloy ribbon piece according to the present disclosure.

The method for manufacturing an alloy ribbon piece according to the present disclosure is a method for manufacturing an alloy ribbon piece obtained by crystallizing an amorphous alloy ribbon piece, the method includes: a preparation step of preparing the amorphous alloy ribbon piece; a first heat treatment step of sequentially heating the amorphous alloy ribbon piece from one end to an intermediate position toward another end to a temperature range equal to or more than a crystallization starting temperature, and stopping the heating when heating the amorphous alloy ribbon piece up to the intermediate position to the temperature range equal to or more than the crystallization starting temperature; and a second heat treatment step of sequentially heating the amorphous alloy ribbon piece from the other end to a position immediately before the intermediate position to the temperature range equal to or more than the crystallization starting temperature. In the second heat treatment step, the amorphous alloy ribbon piece is heated up to the position immediately before the intermediate position to the temperature range equal to or more than the crystallization starting temperature after the heating is stopped in the first heat treatment step. Hereinafter, a direction perpendicular to a direction from the one end to the other end of the amorphous alloy ribbon piece is referred to as "width direction."

First, the method for manufacturing alloy ribbon piece according to the embodiment will be described with an example.

Here, FIG. 1A to FIG. 2B are schematic process drawings illustrating an exemplary method for manufacturing an alloy ribbon piece according to the embodiment.

Figure 1A:
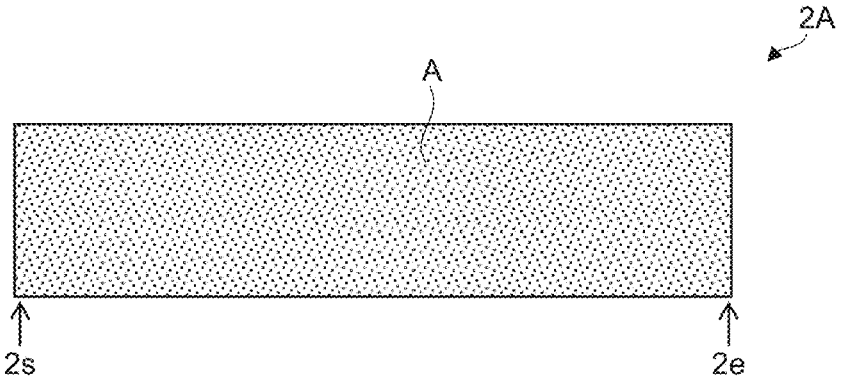
FIGS. 1A to 1C are schematic process drawings illustrating an exemplary method for manufacturing an alloy ribbon piece according to an embodiment.

In this example, first, punching a ribbon piece having a shape to be used for a motor core from continuous sheet-shaped amorphous alloy ribbon pieces (not illustrated), which are manufactured by a common method by, for example, presswork, prepares an approximately strip-shaped amorphous alloy ribbon piece 2A as illustrated in FIG. 1A (preparation step).

Figure 1B:
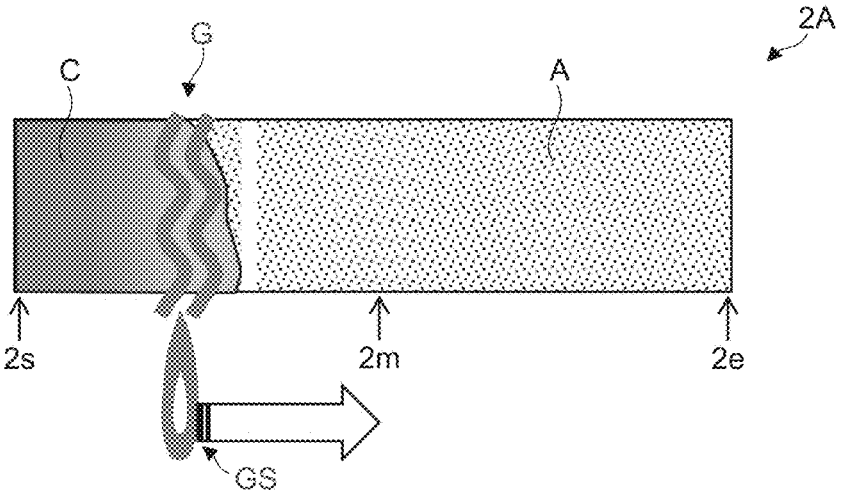
Figure 1C:
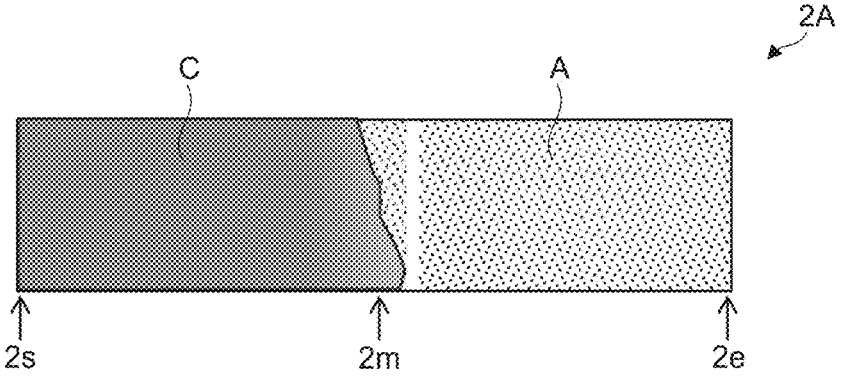

Next, as illustrated in FIG. 1B and FIG. 1C, in a state where the amorphous alloy ribbon piece 2A is put under an air atmosphere at normal temperature, a high temperature gas G sent from a high temperature gas source GS is sequentially applied from one end 2*s* to an intermediate position 2*m* toward another end 2*e* in a planar direction of the amorphous alloy ribbon piece 2A by moving the high temperature gas source GS with respect to the amorphous alloy ribbon piece 2A, and subsequently, the sending of the high temperature gas G is stopped. Thus, the whole region in the width direction is sequentially heated from the one end 2*s* to the intermediate position 2*m* toward the other end 2*e* in the planar direction of the amorphous alloy ribbon piece 2A to a temperature range equal to or more than a crystallization starting temperature, and when heating the amorphous alloy ribbon piece 2A up to the intermediate position 2*m* to the temperature range equal to or more than the crystallization starting temperature, the heating of the amorphous alloy ribbon piece 2A is stopped (first heat treatment step). Accordingly, in the whole region from the one end 2*s* to the intermediate position 2*m* of the amorphous alloy ribbon piece 2A, an amorphous alloy A is crystallized to obtain a nanocrystalline alloy C.

Figure 2A:
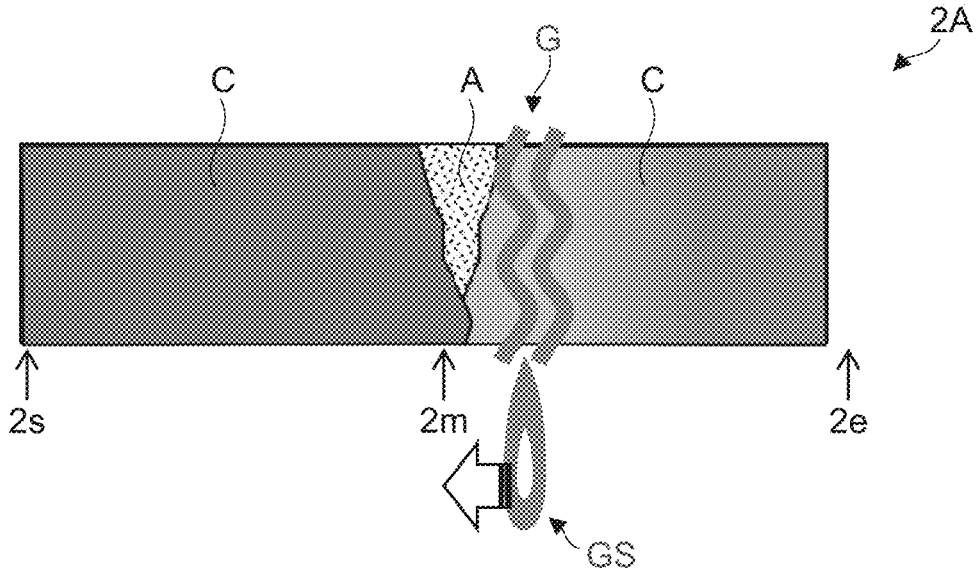
FIGS. 2A and 2B are schematic process drawings illustrating the exemplary method for manufacturing alloy ribbon piece according to the embodiment.
Figure 2B:
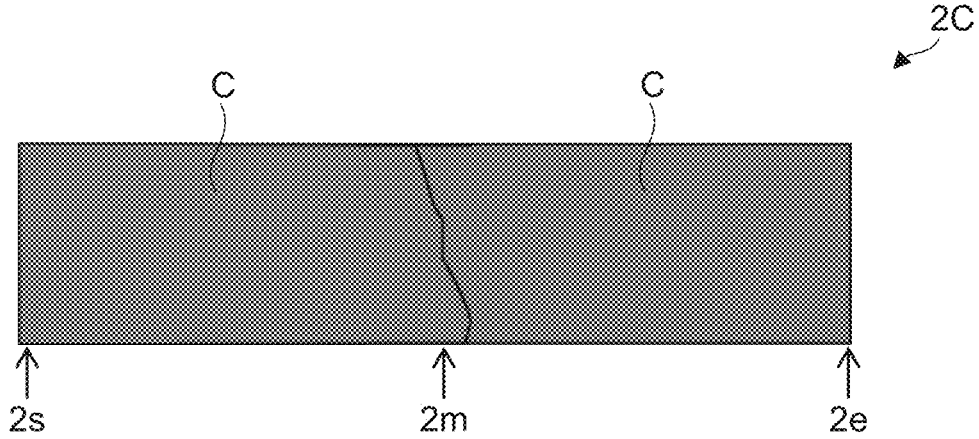

Next, in the state where the amorphous alloy ribbon piece 2A is still put under the air atmosphere at normal temperature, as illustrated in FIG. 2A and FIG. 2B, the high temperature gas G sent from the high temperature gas source GS is sequentially applied from the other end 2*e* to a position immediately before the intermediate position 2*m* in the planar direction of the amorphous alloy ribbon piece 2A by moving the high temperature gas source GS with respect to the amorphous alloy ribbon piece 2A, and subsequently, the sending of the high temperature gas G is stopped. Thus, at a timing later than the timing at which the heating is stopped in the first heat treatment step, the whole region in the width direction is sequentially heated from the other end 2*e* to the position immediately before the intermediate position 2*m* in the planar direction of the amorphous alloy ribbon piece 2A to the temperature range equal to or more than the crystallization starting temperature, and when heating the amorphous alloy ribbon piece 2A up to the position immediately before the intermediate position 2*m* to the temperature range equal to or more than the crystallization starting temperature, the heating of the amorphous alloy ribbon piece 2A is stopped (second heat treatment step). Accordingly, in the whole region from the other end 2*e* to the position immediately before the intermediate position 2*m* of the amorphous alloy ribbon piece 2A, the amorphous alloy A is crystallized to obtain the nanocrystalline alloy C. As described above, a nanocrystalline alloy ribbon piece 2C obtained by crystallizing the whole amorphous alloy ribbon piece 2A is manufactured.

Figure 3A:
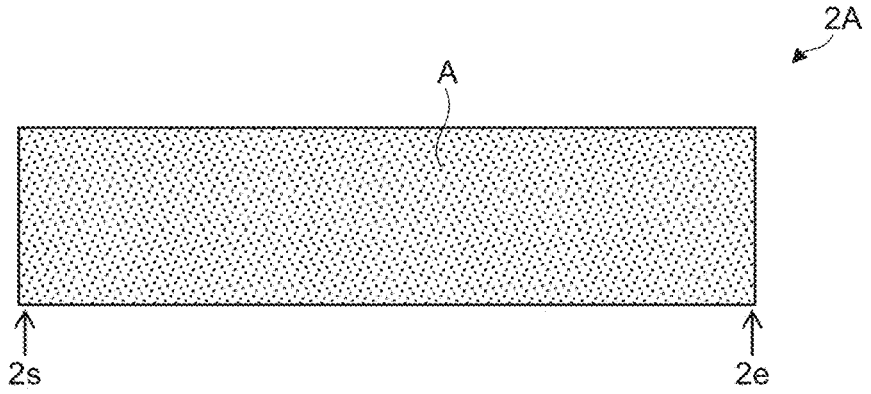
FIGS. 3A to 3C are schematic process drawings illustrating an exemplary conventional method for manufacturing an alloy ribbon piece.
Figure 3B:
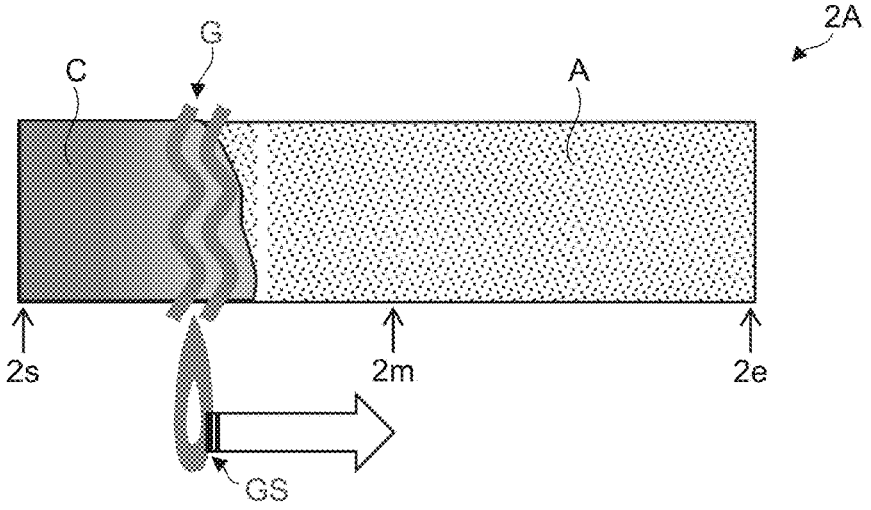
Figure 3C:
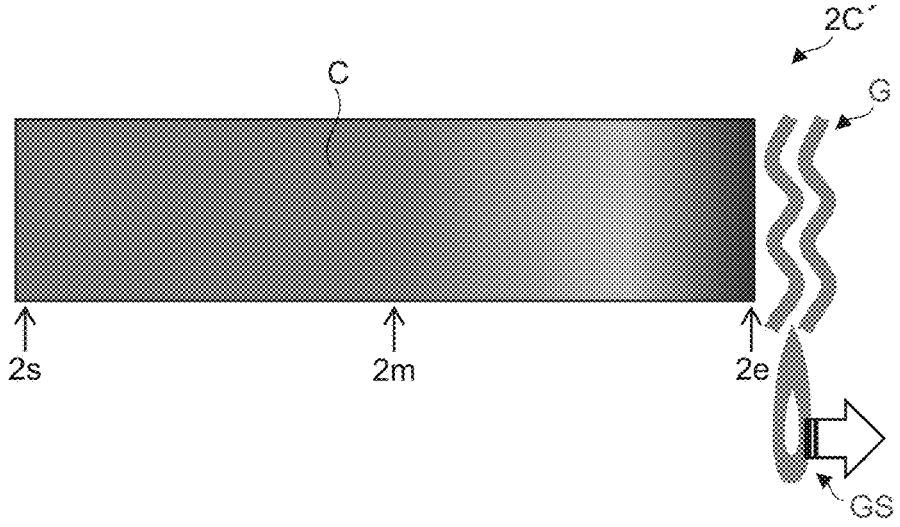
Figure 4:
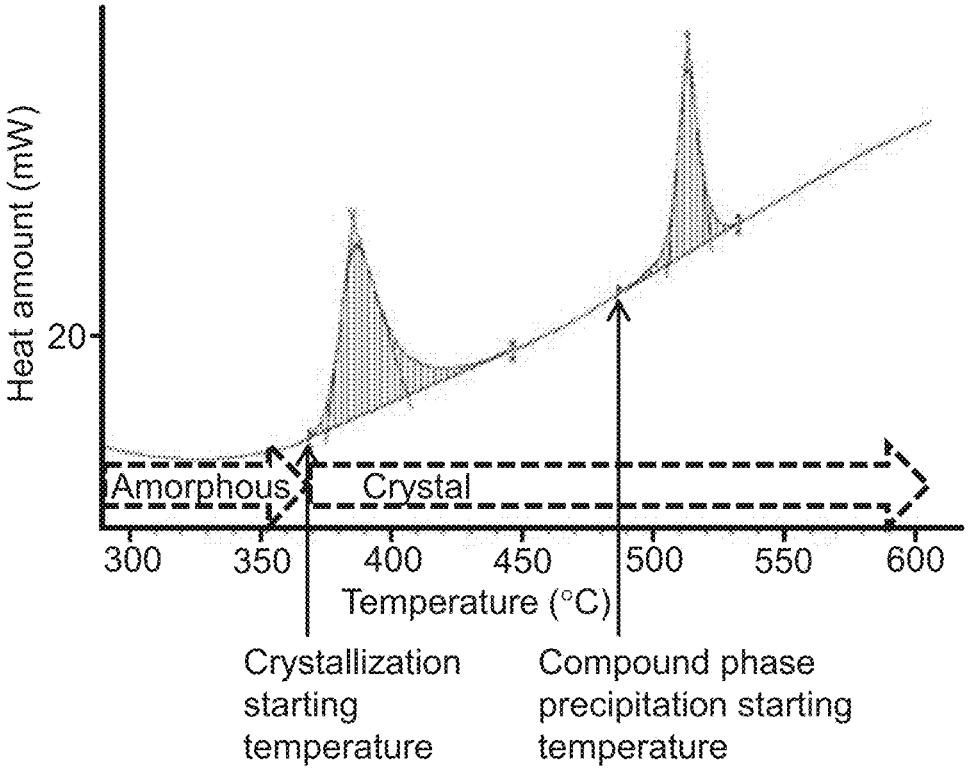
FIG. 4 is a graph illustrating a DSC curve of an amorphous alloy measured with a differential scanning calorimeter (DSC)

Here, a conventional method for manufacturing alloy ribbon piece will be described with an example mainly for difference from the example according to the embodiment. FIG. 3A to FIG. 3C are schematic process drawings illustrating an exemplary conventional method for manufacturing an alloy ribbon piece. FIG. 4 is a graph illustrating a DSC curve of an amorphous alloy measured with a differential scanning calorimeter (DSC).

Conventionally, the amorphous alloy ribbon piece 2A is prepared as illustrated in FIG. 3A, and subsequently, as illustrated in FIG. 3B and FIG. 3C, in the state where the amorphous alloy ribbon piece 2A is put under the air atmosphere at normal temperature, the high temperature gas G sent from the high temperature gas source GS is sequentially applied from the one end 2*s* to the other end 2*e* in the planar direction of the amorphous alloy ribbon piece 2A by moving the high temperature gas source GS with respect to the amorphous alloy ribbon piece 2A, thus applying the high temperature gas G up to the other end 2*e*. Thus, the whole region in the width direction is sequentially heated from the one end 2*s* to the other end 2*e* in the planar direction of the amorphous alloy ribbon piece 2A to the temperature range equal to or more than the crystallization starting temperature. Accordingly, the amorphous alloy A is sequentially crystallized from the one end 2*s* to the other end 2*e* of the amorphous alloy ribbon piece 2A to be attempted to obtain the nanocrystalline alloy C. In this case, as seen from the DSC curve of FIG. 4, a heat due to the crystallization is sequentially generated from the one end 2*s* to the other end 2*e*. Consequentially, the generated heat due to crystallization of the other end 2*e* heated at last has no place to go because the part heated before the other end 2*e* is kept at high temperature. Therefore, in the crystallization of the amorphous alloy ribbon piece 2A, the excessive temperature rise is caused at the other end 2*e* heated at last, and thus, coarse crystal grains and precipitation of a compound phase occur.

In contrast, in the example according to the embodiment, in the state where the amorphous alloy ribbon piece 2A is put under the air atmosphere at normal temperature, the first heat treatment step sequentially heats the amorphous alloy ribbon piece 2A from the one end 2*s* to the intermediate position 2*m* toward the other end 2*e* to the temperature range equal to or more than the crystallization starting temperature, and the heating is stopped when heating the amorphous alloy ribbon piece 2A up to the intermediate position 2*m* to the temperature range equal to or more than the crystallization starting temperature, and the second heat treatment step sequentially heats the amorphous alloy ribbon piece 2A from the other end 2*e* to a position immediately before the intermediate position 2*m* of the amorphous alloy ribbon piece 2A to the temperature range equal to or more than the crystallization starting temperature at a timing later than the timing at which the heating is stopped in the first heat treatment step. Accordingly, when the heat due to the crystallization is sequentially generated from the one end 2*s* to the intermediate position 2*m* of the amorphous alloy ribbon piece 2A by the heating in the first heat treatment step, the generated heat due to crystallization from the one end 2*s* to the intermediate position 2*m* can be escaped to the other end 2*e* side before heating. Furthermore, since this cools the amorphous alloy ribbon piece 2A from the one end 2*s* to the intermediate position 2*m* to, for example, a temperature range less than the crystallization starting temperature, when the heat due to the crystallization is sequentially generated from the other end 2*e* to the position immediately before the intermediate position 2*m* of the amorphous alloy ribbon piece 2A by the heating in the second heat treatment step, the generated heat due to crystallization from the other end 2*e* to the position immediately before the intermediate position 2*m* can be escaped to the cooled one end 2*s* side. In view of this, in the crystallization of the amorphous alloy ribbon piece 2A, the excessive temperature rise can be reduced and the coarse crystal grains and the precipitation of the compound phase can be suppressed without performing an operation to absorb the generated heat due to crystallization using an additionally prepared endothermic member.

In the embodiment, as the example according to the embodiment, a first heat treatment step sequentially heats an amorphous alloy ribbon piece from one end to an intermediate position toward another end to a temperature range equal to or more than a crystallization starting temperature, and the heating is stopped when heating the amorphous alloy ribbon piece up to the intermediate position to the temperature range equal to or more than the crystallization starting temperature. The second heat treatment step heats the amorphous alloy ribbon piece up to the position immediately before the intermediate position to the temperature range equal to or more than the crystallization starting temperature at a timing later than the timing at which the heating is stopped in the first heat treatment step in a case of sequentially heating the amorphous alloy ribbon piece from the other end to the position immediately before the intermediate position. Accordingly, when the heat due to the crystallization is sequentially generated from the one end to the intermediate position of the amorphous alloy ribbon piece by the heating in the first heat treatment step, the generated heat due to crystallization from the one end to the intermediate position can be escaped to the other end side before heating, and when the heat due to the crystallization is sequentially generated from the other end of the amorphous alloy ribbon piece to the position immediately before the intermediate position by the heating in the second heat treatment step, the generated heat due to crystallization from the other end to the position immediately before the intermediate position can be escaped to the cooled one end side. In view of this, in the crystallization of the amorphous alloy ribbon piece, the excessive temperature rise can be reduced and the coarse crystal grains and the precipitation of the compound phase can be suppressed without performing an operation to absorb the generated heat due to crystallization using an additionally prepared endothermic member. Therefore, the nanocrystalline alloy ribbon piece obtained by crystallizing the amorphous alloy ribbon piece can be manufactured with high productivity.

Next, the method for manufacturing alloy ribbon piece according to the embodiment will be described in detail mainly for the conditions.

1. Preparation Step

In the preparation step, the amorphous alloy ribbon piece is prepared.

Here, the "amorphous alloy ribbon piece" means a ribbon piece, which is used for, for example, a component such as a core in a final product such as a motor, punched in a desired shape from a continuous sheet-shaped amorphous alloy ribbon manufactured by a common method such as a single roll method and a twin roll method.

While the amorphous alloy ribbon piece is not specifically limited insofar as the amorphous alloy ribbon piece is a ribbon piece punched in the desired shape, for example, a ribbon constituting a stator core or a rotor core of a motor and a ribbon obtained by further dividing the ribbon constituting the stator core or the rotor core in a circumferential direction are included.

While the material of the amorphous alloy ribbon piece is not specifically limited insofar as the material is the amorphous alloy, for example, a Fe-based amorphous alloy, a Ni-based amorphous alloy, and a Co-based amorphous alloy are included. Especially, the Fe-based amorphous alloy and the like may be used. Here, the "Fe-based amorphous alloy" means an amorphous alloy that contains Fe as a main component, and contains impurities such as B, Si, C, P, Cu, Nb, and Zr. The "Ni-based amorphous alloy" means an amorphous alloy that contains Ni as a main component. The "Co-based amorphous alloy" means an amorphous alloy that contains Co as a main component.

The Fe-based amorphous alloy may have, for example, a Fe content in a range of 84 atomic percent or more, and has a larger Fe content in some embodiments. This is because a magnetic-flux density of the alloy ribbon piece obtained by crystallizing the amorphous alloy ribbon piece differs depending on the Fe content.

For example, when the material is the Fe-based amorphous alloy, a size (longitudinal×lateral) of a rectangular amorphous alloy ribbon piece is, for example, 100 mm×100 mm, and a diameter of a circular amorphous alloy ribbon piece is, for example, 150 mm.

The thickness of the amorphous alloy ribbon piece is not specifically limited, but different depending on the material and the like of the amorphous alloy ribbon piece. When the material is the Fe-based amorphous alloy, the thickness is, for example, in a range of 10 μm or more and 100 μm or less, and may be in a range of 20 μm or more and 50 μm or less.

2. First Heat Treatment Step

The first heat treatment step sequentially heats the amorphous alloy ribbon piece from the one end to the intermediate position toward the other end to the temperature range equal to or more than the crystallization starting temperature, and the heating is stopped when heating the amorphous alloy ribbon piece up to the intermediate position to the temperature range equal to or more than the crystallization starting temperature. Specifically, the first heat treatment step sequentially heats the amorphous alloy ribbon piece from the one end to the intermediate position toward the other end to the temperature range equal to or more than the crystallization starting temperature and keeps the temperature range for a time required for crystallization, and the heating of the amorphous alloy ribbon piece is stopped when heating the amorphous alloy ribbon piece up to the intermediate position to the temperature range equal to or more than the crystallization starting temperature and keeping the temperature range for the time required for crystallization. Accordingly, in the region from the one end to the intermediate position of the amorphous alloy ribbon piece, the amorphous alloy is crystallized to obtain the nanocrystalline alloy.

Here, the "one end of the amorphous alloy ribbon piece" means one end in the planar direction of the amorphous alloy ribbon piece, and the "other end of the amorphous alloy ribbon piece" means an end on the opposite side in the planar direction to the one end of the amorphous alloy ribbon piece.

The "crystallization starting temperature" means a temperature at which the crystallization of the amorphous alloy ribbon piece starts when the amorphous alloy ribbon piece is heated. The crystallization of the amorphous alloy ribbon piece differs depending on the material and the like of the amorphous alloy ribbon piece, and when the material is the Fe-based amorphous alloy, for example, the crystallization is a reaction where a fine bccFe crystal precipitates. The crystallization starting temperature differs depending on the material and the like of the amorphous alloy ribbon piece and a heating rate. The crystallization starting temperature tends to become high with the increased heating rate, and in the case of the Fe-based amorphous alloy, for example, the crystallization starting temperature is in a range of 350° C. to 500° C.

The temperature range equal to or more than the crystallization starting temperature is not specifically limited, but may be a temperature range less than a compound phase precipitation starting temperature. Because the precipitation of the compound phase can be suppressed. Here, the "compound phase precipitation starting temperature" means a temperature at which the precipitation of the compound phase starts when the amorphous alloy ribbon piece after the start of the crystallization is further heated, for example, as indicated by the DSC curve of FIG. 4. The "compound phase" means a compound phase that precipitates when the amorphous alloy ribbon piece after the start of the crystallization is further heated and deteriorates the soft magnetic properties, for example, the compound phase such as Fe—B and Fe—P in the case of the Fe-based amorphous alloy.

The temperature range equal to or more than the crystallization starting temperature and less than the compound phase precipitation starting temperature is not specifically limited, but differs depending on the material and the like of the amorphous alloy ribbon piece. When the material is the Fe-based amorphous alloy, the temperature range may be, for example, in a range of equal to or more than the crystallization starting temperature and equal to or less than the crystallization starting temperature+100° C., and may be in a range of equal to or more than the crystallization starting temperature+30° C. and equal to or less than the crystallization starting temperature+50° C. in some embodiments. Because the lower limits or more of these ranges ensures faster crystallization of the amorphous alloy ribbon piece. Because the upper limits or less of these ranges ensures effectively suppressing coarse crystal grains.

The method for sequentially heating the amorphous alloy ribbon piece from the one end to the intermediate position to the temperature range equal to or more than the crystallization starting temperature is not specifically limited, but includes induction heating and the like in addition to the method to apply the high temperature gas as illustrated in FIG. 1B.

Figure 5A:
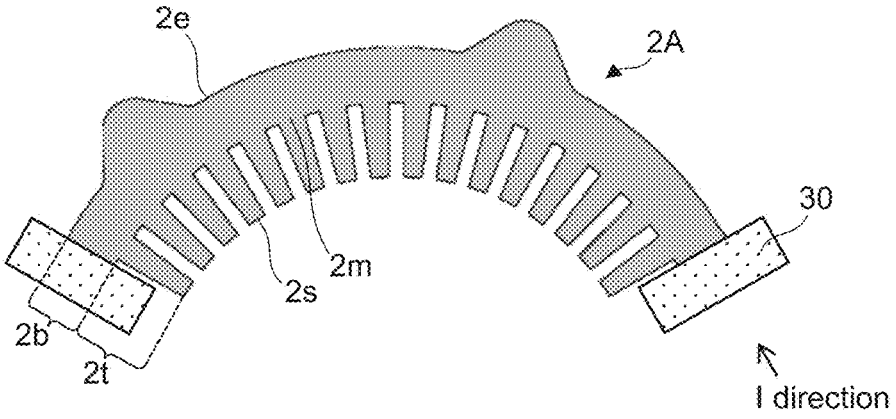
FIGS. 5A to 5C are schematic process plan views illustrating another example of the method for manufacturing alloy ribbon piece according to the embodiment.
Figure 5B:
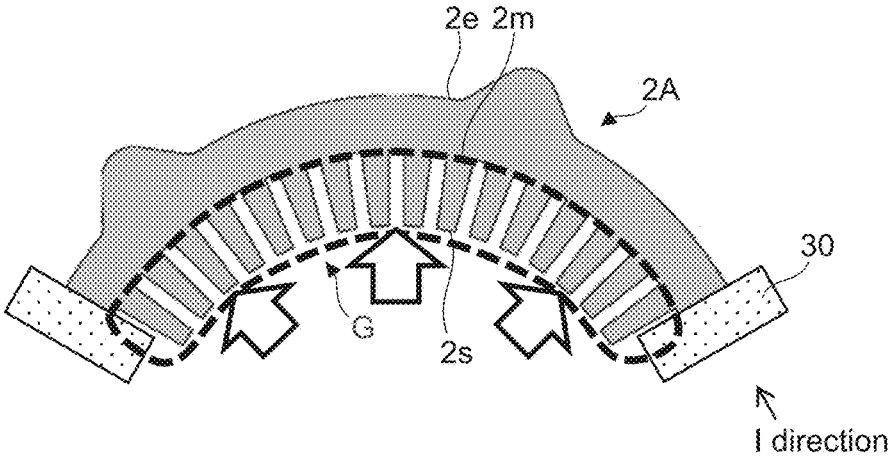

The method to apply the high temperature gas includes, for example, the method to sequentially apply the high temperature gas from the one end to the intermediate position of the amorphous alloy ribbon piece by moving the high temperature gas source with respect to the amorphous alloy as illustrated in FIG. 1B, and in addition, for example, a method to sequentially apply the high temperature gas from the one end to the intermediate position of the amorphous alloy ribbon piece from the high temperature gas source fixed at a position facing the one end of the amorphous alloy ribbon piece as illustrated in FIG. 5B described below.

The high temperature gas source includes, for example, an industrial dryer. The method to move the high temperature gas source with respect to the amorphous alloy ribbon piece is not specifically limited insofar as it is a method to relatively move the high temperature gas source with respect to the amorphous alloy ribbon piece, and may be a method to move the high temperature gas source, or may be a method to move the amorphous alloy ribbon piece.

3. Second Heat Treatment Step

The second heat treatment step sequentially heats the amorphous alloy ribbon piece from the other end to a position immediately before the intermediate position to the temperature range equal to or more than the crystallization starting temperature. In this case, the second heat treatment step heats the amorphous alloy ribbon piece up to the position immediately before the intermediate position to the temperature range equal to or more than the crystallization starting temperature after the heating is stopped in the first heat treatment step. Specifically, the second heat treatment step sequentially heats the amorphous alloy ribbon piece from the other end to the position immediately before the intermediate position to the temperature range equal to or more than the crystallization starting temperature and keeps the temperature range for the time required for crystallization. In this case, the second heat treatment step heats the amorphous alloy ribbon piece up to the position immediately before the intermediate position to the temperature range equal to or more than the crystallization starting temperature and keeps the temperature range for the time required for crystallization at a timing later than the timing at which the heating is stopped in the first heat treatment step. Accordingly, in the region from the other end of the amorphous alloy ribbon piece to the position immediately before the intermediate position, the amorphous alloy is crystallized to obtain the nanocrystalline alloy.

Since the second heat treatment step is not specifically limited insofar as it is a step as described above, the second heat treatment step may be a step where the heating to the temperature range equal to or more than the crystallization starting temperature is started from the other end of the amorphous alloy ribbon piece after the heating is stopped in the first heat treatment step, or may be a step where the heating to the temperature range equal to or more than the crystallization starting temperature is started from the other end of the amorphous alloy ribbon piece before the heating is stopped in the first heat treatment step and the heating to the temperature range equal to or more than the crystallization starting temperature is performed up to the position immediately before the intermediate position of the amorphous alloy ribbon piece after the heating is stopped in the first heat treatment step. In the step where the heating to the temperature range equal to or more than the crystallization starting temperature is started from the other end of the amorphous alloy ribbon piece before the heating is stopped in the first heat treatment step, the first heat treatment step and the second heat treatment step are concurrently performed.

Since the temperature range equal to or more than the crystallization starting temperature is similar to that of the first heat treatment step, the description is omitted here.

The method to sequentially heat the amorphous alloy ribbon piece from the other end to the position immediately before the intermediate position to the temperature range equal to or more than the crystallization starting temperature is not specifically limited, but includes induction heating and the like in addition to the method to apply the high temperature gas as illustrated in FIG. 2A.

Figure 5C:
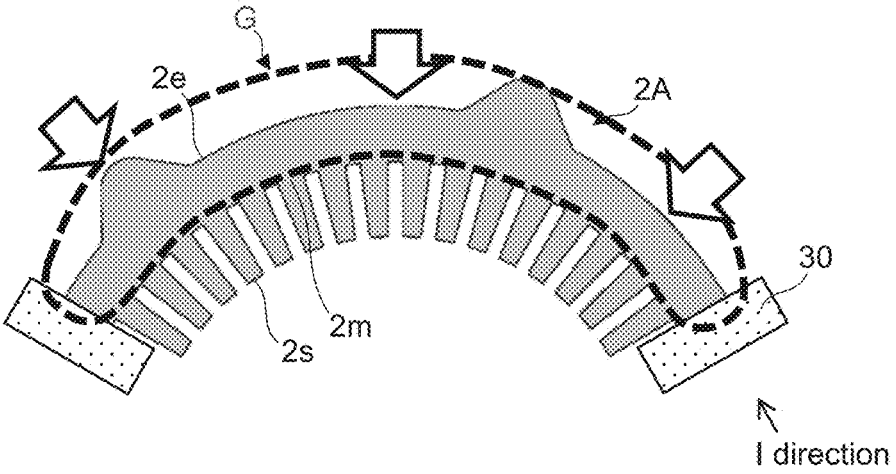

The method to apply the high temperature gas includes, for example, the method to sequentially apply the high temperature gas from the other end of the amorphous alloy ribbon piece to the position immediately before the intermediate position by moving the high temperature gas source with respect to the amorphous alloy as illustrated in FIG. 2A, and in addition, for example, a method to sequentially apply the high temperature gas from the other end of the amorphous alloy ribbon piece to the position immediately before the intermediate position from the high temperature gas source fixed at a position facing the other end of the amorphous alloy ribbon piece as illustrated in FIG. 5C described below. Since the high temperature gas source and the method to move the high temperature gas source with respect to the amorphous alloy ribbon piece are similar to those of the first heat treatment step, the description is omitted here.

In the second heat treatment step, the heating the amorphous alloy ribbon piece up to the position immediately before the intermediate position to the temperature range equal to or more than the crystallization starting temperature may be performed after the elapse of one second or more from the stop of the heating in the first heat treatment step, and the heating may be performed after the elapse of three seconds or more, or five seconds or more in some embodiments. This is because, since the heating the amorphous alloy ribbon piece up to the position immediately before the intermediate position to the temperature range equal to or more than the crystallization starting temperature in the second heat treatment step is performed after the effectively cooling the amorphous alloy ribbon piece from the one end to the intermediate position, the generated heat due to crystallization from the other end to the position immediately before the intermediate position can be effectively escaped to the one end side.

In the second heat treatment step, the amorphous alloy ribbon piece may be heated up to the position immediately before the intermediate position to the temperature range equal to or more than the crystallization starting temperature after the intermediate position of the amorphous alloy ribbon piece is cooled to the temperature range less than the crystallization starting temperature after the stop of the heating in the first heat treatment step. This is because, since the heating the amorphous alloy ribbon piece up to the position immediately before the intermediate position to the temperature range equal to or more than the crystallization starting temperature is performed after the effective cooling from the one end to the intermediate position of the amorphous alloy ribbon piece, the generated heat due to crystallization immediately before the intermediate position can be effectively escaped to the one end side. The temperature range less than the crystallization starting temperature is not specifically limited, and differs depending on the material and the like of the amorphous alloy ribbon piece. When the material is the Fe-based amorphous alloy, the temperature range may be a temperature range equal to or less than the crystallization starting temperature −30° C., or equal to or less than the crystallization starting temperature −50° C. in some embodiments.

4. Method for Manufacturing Alloy Ribbon Piece

With the method for manufacturing alloy ribbon piece according to the embodiment, the nanocrystalline alloy ribbon piece obtained by crystallizing the amorphous alloy ribbon piece is manufactured.

Here, the "nanocrystalline alloy ribbon piece" means a nanocrystalline alloy ribbon piece that provides soft magnetic properties such as a desired coercivity by precipitating fine crystal grains without substantially causing the precipitation of the compound phase and the coarse crystal grains. The material of the nanocrystalline alloy ribbon piece differs depending on the material and the like of the amorphous alloy ribbon piece, and when the material of the amorphous alloy ribbon piece is the Fe-based amorphous alloy, the material of the nanocrystalline alloy ribbon piece is, for example, a Fe-based nanocrystalline alloy having a mixed phase structure of crystal grains of Fe or Fe alloy (for example, fine bccFe crystal) and amorphous phases.

The grain diameter of the crystal grain of the nanocrystalline alloy ribbon piece is not specifically limited insofar as the desired soft magnetic properties are obtained, and differs depending on the material and the like. When the material is the Fe-based nanocrystalline alloy, for example, the grain diameter may be in a range of 25 nm or less. Because coarsening deteriorates the coercivity. The grain diameter of the crystal grain can be measured through, for example, a direct observation using a transmission electron microscope (TEM). The grain diameter of the crystal grain can be estimated from the coercivity or a temperature profile of the nanocrystalline alloy ribbon piece.

The coercivity of the nanocrystalline alloy ribbon piece differs depending on the material and the like of the nanocrystalline alloy ribbon piece, and when the material is the Fe-based nanocrystalline alloy, the coercivity is, for example, 20 A/m or less and may be 10 A/m or less. This is because, thus decreasing the coercivity ensures effectively reducing, for example, a loss in the core of the motor and the like. The coercivity can be measured using, for example, a vibrating sample magnetometer (VSM).

In the method for manufacturing alloy ribbon piece, the atmosphere under which the preparation step, the first heat treatment step, and the second heat treatment step are performed is not specifically limited, but may include an air atmosphere and the like.

The temperature of the atmosphere under which the preparation step, the first heat treatment step, and the second heat treatment step are performed is not specifically limited insofar as it is a temperature at which the heated part of the amorphous alloy ribbon piece is cooled by stopping the heating, and the temperature differs depending on the material and the like of the amorphous alloy ribbon piece. When the material is the Fe-based amorphous alloy, the temperature may be, for example, in a range of 0° C. to 100° C., and is in a range of 15° C. to 25° C. in some embodiments. Because the lower limit or more of these ranges ensures facilitated sequential crystallization from the one end to the intermediate position of the amorphous alloy ribbon piece. The upper limit or less of these ranges ensures effective cooling of the heated part of the amorphous alloy ribbon piece when the heating is stopped. The temperature of the atmosphere may be a normal temperature. The "normal temperature" means a temperature not especially cooled or heated, that is, a room temperature indoor or an air temperature outdoor, and for example, a temperature in a range of 20° C.±15° C. specified in JIS Z 8703.

Figure 6A:
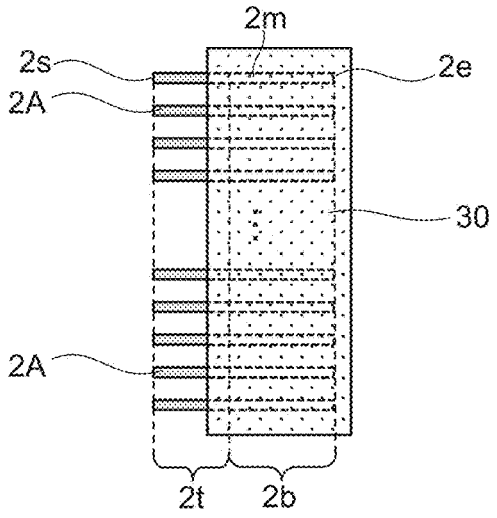
FIGS. 6A to 6C are schematic process side views illustrating the other example of the method for manufacturing alloy ribbon piece according to the embodiment.
Figure 6B:
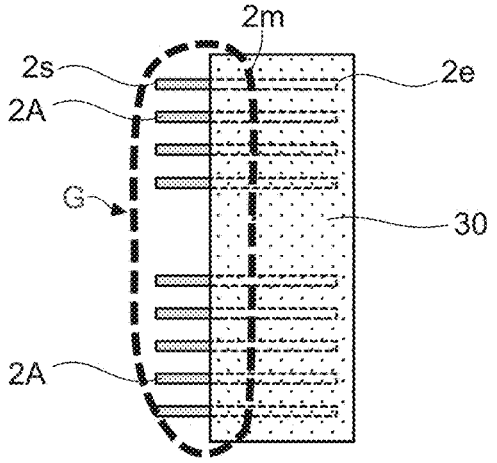
Figure 6C:
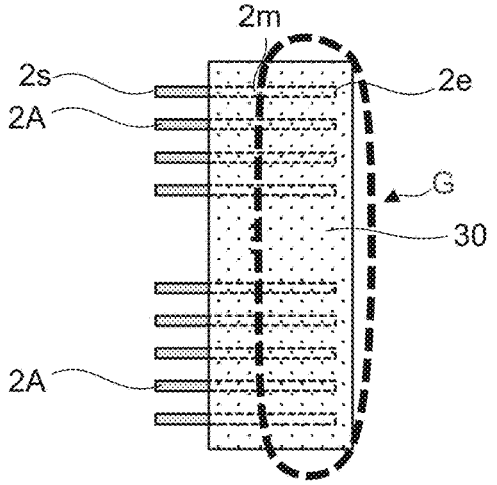

Here, FIG. 5A to FIG. 5C are schematic process plan views illustrating another example of the method for manufacturing alloy ribbon piece according to the embodiment. FIG. 6A to FIG. 6C are schematic process side views illustrating the other example of the method for manufacturing alloy ribbon piece according to the embodiment, and arrow views in I directions of FIG. 5A to FIG. 5C, respectively.

In this example, first, from continuous sheet-shaped amorphous alloy ribbon (not illustrated) manufactured by a common method, by, for example, a presswork, a plurality of ribbon pieces having shapes into which a circular alloy ribbon constituting a motor stator core is divided are punched, thus a plurality of amorphous alloy ribbon pieces 2A illustrated in FIG. 5A and FIG. 6A are prepared. As illustrated in FIG. 5A and FIG. 6A, the plurality of amorphous alloy ribbon pieces 2A are fixed using a jig 30 in a state of being laminated so as to have a clearance between the adjacent amorphous alloy ribbon pieces 2A (preparation step). The amorphous alloy ribbon piece 2A has the shape into which the circular alloy ribbon constituting the stator core is divided, and has an inner edge (one end) 2*s* side as a teeth portion 2*t* and an outer edge (other end) 2*e* side as a back yoke portion 2*b*. A cross-sectional area perpendicular to a radial direction of the teeth portion 2*t* is smaller than that of the back yoke portion 2*b*.

Next, as illustrated in FIG. 5B and FIG. 6B, in a state where the plurality of amorphous alloy ribbon pieces 2A are put under the air atmosphere at normal temperature, by sending a high temperature gas G from a high temperature gas source (not illustrated) fixed at a position facing the inner edges 2*s* of the plurality of amorphous alloy ribbon pieces 2A toward the inner edges 2*s* of the amorphous alloy ribbon pieces 2A, the high temperature gas G is sequentially applied from the inner edges 2*s* of the plurality of amorphous alloy ribbon pieces 2A to boundaries (intermediate positions) 2*m* between the teeth portions 2*t* and back yoke portions 2*b* toward the outer edges 2*e* such that the high temperature gas G enters the clearance between the adjacent amorphous alloy ribbon pieces 2A, and subsequently, the sending of the high temperature gas G is stopped. Thus, the whole region in the width direction is sequentially heated from the inner edges 2*s* of the plurality of amorphous alloy ribbon pieces 2A to the boundaries 2*m* to the temperature range equal to or more than the crystallization starting temperature, and the heating of the amorphous alloy ribbon pieces 2A is stopped when heating the amorphous alloy ribbon pieces 2A up to the boundaries 2*m* to the temperature range equal to or more than the crystallization starting temperature (first heat treatment step). Accordingly, in the whole of the teeth portions 2*t* from the inner edges 2*s* of the plurality of amorphous alloy ribbon pieces 2A to the boundaries 2*m*, the amorphous alloy is crystallized to obtain the nanocrystalline alloy.

Next, as illustrated in FIG. 5C and FIG. 6C, in a state where the plurality of amorphous alloy ribbon pieces 2A are still put under the air atmosphere at normal temperature, by sending the high temperature gas G from the high temperature gas source (not illustrated) fixed at a position facing the outer edges 2*e* of the plurality of amorphous alloy ribbon pieces 2A toward the outer edges 2*e* of the amorphous alloy ribbon pieces 2A, the high temperature gas G is sequentially applied from the outer edges 2*e* of the plurality of amorphous alloy ribbon pieces 2A to a position immediately before the boundaries 2*m* between the teeth portions 2*t* and back yoke portions 2*b* such that the high temperature gas G enters the clearance between the adjacent amorphous alloy ribbon pieces 2A, and subsequently, the sending of the high temperature gas G is stopped. Thus, at a timing later than the timing at which the heating is stopped in the first heat treatment step, the whole region in the width direction is sequentially heated from the outer edges 2*e* of the plurality of amorphous alloy ribbon pieces 2A to the position immediately before the boundaries 2*m* to the temperature range equal to or more than the crystallization starting temperature, and the heating of the amorphous alloy ribbon pieces 2A is stopped when heating the amorphous alloy ribbon pieces 2A up to the position immediately before the boundaries 2*m* to the temperature range equal to or more than the crystallization starting temperature (second heat treatment step). Accordingly, in the whole of the back yoke portions 2*b* from the outer edges 2*e* of the plurality of amorphous alloy ribbon pieces 2A to the position immediately before the boundaries 2*m*, the amorphous alloy is crystallized to obtain the nanocrystalline alloy. As described above, a plurality of nanocrystalline alloy ribbon pieces obtained by crystallizing the whole of the plurality of amorphous alloy ribbon pieces 2A are manufactured.

For the amorphous alloy ribbon piece 2A, the cross-sectional area perpendicular to the radial direction of the teeth portion 2*t* on the inner edge 2*s* side is smaller than that of the back yoke portion 2*b* on the outer edge 2*e* side. Accordingly, it is different from this example, assuming that the first heat treatment step sequentially heats the amorphous alloy ribbon piece 2A from the outer edge 2*e* to the boundary 2*m* to the temperature range equal to or more than the crystallization starting temperature, when the heat due to crystallization is sequentially generated from the outer edge 2*e* to the boundary 2*m* by the heating in the first heat treatment step, the generated heat due to crystallization of the back yoke portion 2*b* from the outer edge 2*e* to the boundary 2*m* is to be escaped to the teeth portion 2*t* before heating which is smaller in cross-sectional area than the back yoke portion 2*b*. Consequentially, the excessive temperature rise due to the crystallization is caused at the teeth portion 2*t*, thus the coarse crystal grains and the precipitation of the compound phase possibly occur. In contrast, according to this example, since the first heat treatment step sequentially heats the amorphous alloy ribbon piece 2A from the inner edge 2*s* to the boundary 2*m* to the temperature range equal to or more than the crystallization starting temperature, when the heat due to crystallization is sequentially generated from the inner edge 2*s* to the boundary 2*m* by the heating in the first heat treatment step, the generated heat due to crystallization of the teeth portion 2*t* from the inner edge 2*s* to the boundary 2*m* can be escaped to the back yoke portion 2*b* before heating which is larger in cross-sectional area than the teeth portion 2*t*. Therefore, the excessive temperature rise is easily reduced, and the coarse crystal grains and the precipitation of the compound phase are easily suppressed. In this example, when the heat due to crystallization is sequentially generated from the outer edge 2*e* to the boundary 2*m* by the heating in the second heat treatment step, the generated heat due to crystallization of the back yoke portion 2*b* is to be escaped to the teeth portion 2*t* which is smaller in cross-sectional area than the back yoke portion 2*b*. In this case, since the teeth portion 2*t* has been already crystallized, the coarse crystal grains and the like caused by the excessive temperature rise due to the crystallization is less likely to occur.

The method for manufacturing alloy ribbon piece is not specifically limited, but may be a method, for example, as the example illustrated in FIG. 5A to FIG. 6C, where the cross-sectional area on the one end side of the amorphous alloy ribbon piece is smaller than the cross-sectional area on the other end side. This is because, in the crystallization of the amorphous alloy ribbon piece, crystallizing the other end side having the large cross-sectional area after the crystallization of the one end side having the small cross-sectional area ensures releasing the generated heat due to crystallization of the part having the small cross-sectional area to the part having the large cross-sectional area before crystallization, thus easily reducing the excessive temperature rise and easily suppressing the coarse crystal grains and the precipitation of the compound phase.

The method for manufacturing alloy ribbon piece is not specifically limited, but may be a method, for example, as the example illustrated in FIG. 5A to FIG. 6C, that includes: a preparation step where a plurality of amorphous alloy ribbon pieces are prepared, and subsequently, the plurality of amorphous alloy ribbon pieces are fixed using a jig in a state of being laminated so as to have a clearance between the adjacent amorphous alloy ribbon pieces; a first heat treatment step sequentially heating the plurality of amorphous alloy ribbon pieces from one end to an intermediate position toward the other end to the temperature range equal to or more than the crystallization starting temperature, and stopping the heating when heating the plurality of amorphous alloy ribbon pieces up to the intermediate position to the temperature range equal to or more than the crystallization starting temperature; and a second heat treatment step sequentially heating the plurality of amorphous alloy ribbon pieces from the other end to a position immediately before the intermediate position to the temperature range equal to or more than the crystallization starting temperature, and heating the plurality of amorphous alloy ribbon pieces up to the position immediately before the intermediate position to the temperature range equal to or more than the crystallization starting temperature after the heating is stopped in the first heat treatment step. Because this method is advantageous for mass production.

The method for manufacturing alloy ribbon piece according to the embodiment is not specifically limited insofar as the nanocrystalline alloy ribbon piece can be manufactured, but may be a manufacturing method where, for example, the whole of the amorphous alloy ribbon piece is crystallized to obtain a desired grain diameter of the crystal grain of the nanocrystalline alloy ribbon piece without substantially causing the precipitation of the compound phase and the coarse crystal grains. In the method for manufacturing alloy ribbon piece according to the embodiment, in order to crystallize the whole of the amorphous alloy ribbon piece to obtain the desired grain diameter of the crystal grain of the nanocrystalline alloy ribbon piece without substantially causing the precipitation of the compound phase and the coarse crystal grains, other conditions may be appropriately set in addition to the above-described conditions. Not only the respective conditions are appropriately set independently, but also combinations of the respective conditions may be appropriately set.

EXAMPLES

The following further specifically describes the method for manufacturing alloy ribbon piece according to the embodiment with Example.

Example

An experiment on the method for manufacturing alloy ribbon piece was performed. The following specifically describes the experiment.

<Amorphous Alloy Ribbon Piece>

Figure 7:
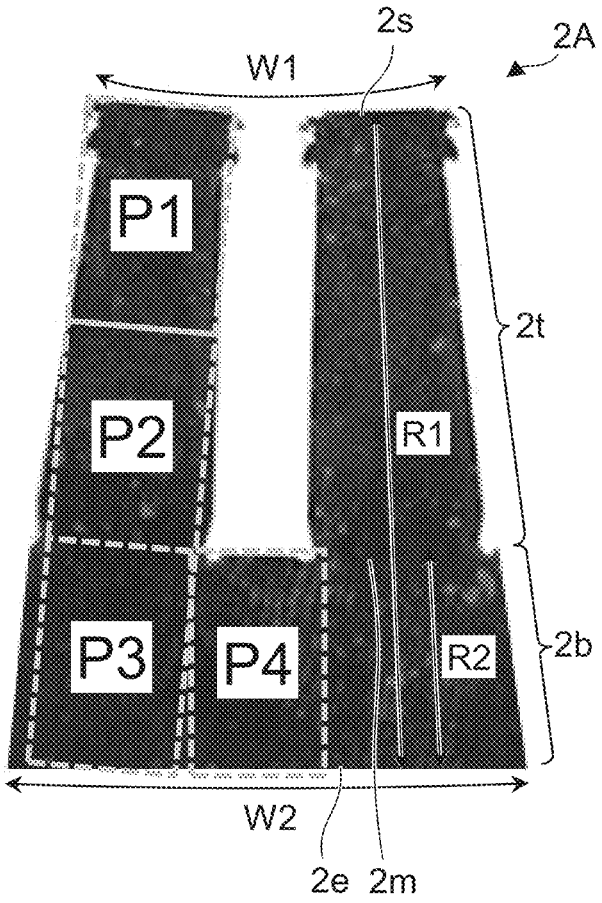
FIG. 7 is a photograph of an amorphous alloy ribbon piece used in an experiment on the method for manufacturing alloy ribbon piece of an example.

FIG. 7 is a photograph of an amorphous alloy ribbon piece used in the experiment on the method for manufacturing alloy ribbon piece of Example. As illustrated in FIG. 7, the amorphous alloy ribbon piece 2A used in the experiment is a ribbon having a shape into which a circular alloy ribbon constituting a motor stator core is divided. The amorphous alloy ribbon piece 2A contains a Fe-based amorphous alloy having a Fe content of 84 atomic percent or more, and its size is as follows.

Thickness T: 0.025 mm
Whole Radial Length R1: 50 mm
Back Yoke Portion Radial Length R2: 15 mm
Inner Edge Length W1: 28 mm
Outer Edge Length W2: 40 mm The coercivity Hc at each position in the planar direction of the amorphous alloy ribbon piece 2A before crystallization was about 8 A/m. The magnetic-flux density Bs at each position in the planar direction of the amorphous alloy ribbon piece 2A before crystallization was 1.6 T or less.

<Experimental Condition>

The experiment was performed in a state where the amorphous alloy ribbon piece 2A was put under the air atmosphere at normal temperature (15° C.). In the experiment, first, an industrial dryer (GHG 660LCD manufactured by Robert Bosch GmbH) (not illustrated) was fixed so as to have a nozzle (1 609 201 795 manufactured by Robert Bosch GmbH) (not illustrated) at a position facing the inner edge 2*s* of the amorphous alloy ribbon piece 2A apart from the inner edge 2*s* by 20 mm, a high temperature gas at 440° C. was sent from the industrial dryer toward the inner edge 2*s* of the amorphous alloy ribbon piece 2A with a velocity of 1 m/sec to apply the high temperature gas from the inner edge 2*s* to the boundary 2*m* between the teeth portion 2*t* and the back yoke portion 2*b* toward the outer edge 2*e* of the amorphous alloy ribbon piece 2A for 10 seconds, and subsequently, the sending of the high temperature gas was stopped (first heat treatment step). Thus, the amorphous alloy ribbon piece 2A was sequentially crystallized from the inner edge 2*s* to the boundary 2*m*.

Next, the industrial dryer was fixed so as to have the nozzle at a position facing the outer edge 2*e* of the amorphous alloy ribbon piece 2A apart from the outer edge 2*e* by 20 mm, the high temperature gas at 440° C. was sent from the industrial dryer toward the outer edge 2*e* of the amorphous alloy ribbon piece 2A with a velocity of 1 m/sec after the elapse of five seconds from the stop of the sending of the high temperature gas in the first heat treatment step, the high temperature gas was applied thereby from the outer edge 2*e* to immediately before the boundary 2*m* of the amorphous alloy ribbon piece 2A for 10 seconds, and subsequently, the sending of the high temperature gas was stopped (second heat treatment step). Thus, the amorphous alloy ribbon piece 2A was sequentially crystallized from the outer edge 2*e* to immediately before the boundary 2*m*, and the alloy ribbon piece obtained by crystallizing the amorphous alloy ribbon piece 2A was thereby manufactured.

<Experimental Result>

Figure 8:
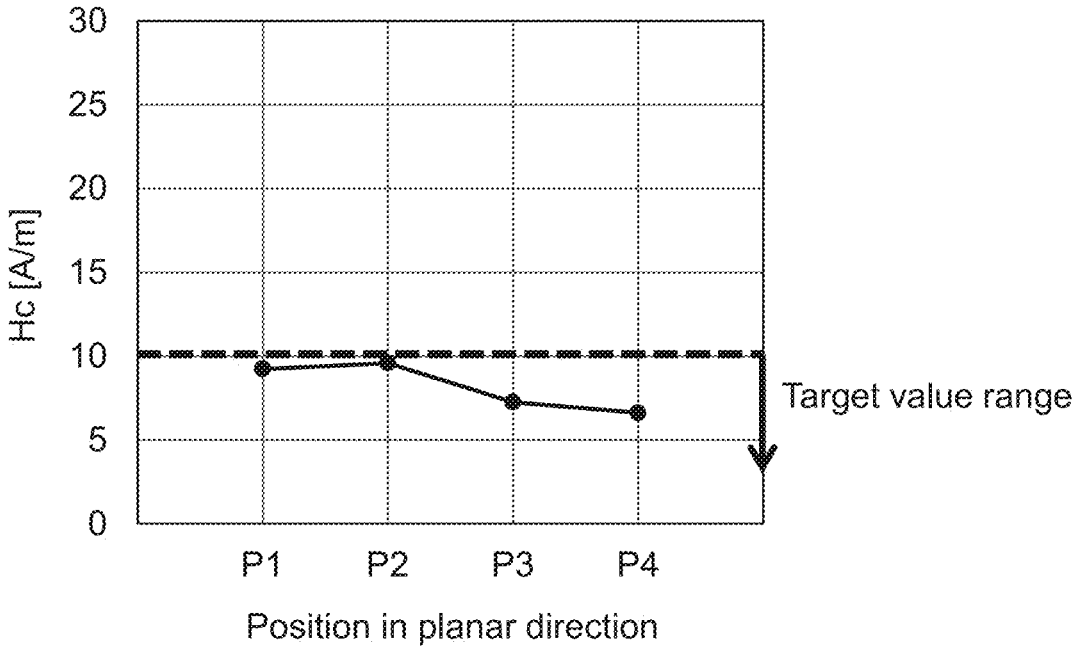
FIG. 8 is a graph indicating a coercivity Hc at each position in a planar direction of the alloy ribbon piece crystallized in the experiment on the method for manufacturing alloy ribbon piece of the example.

For the alloy ribbon piece obtained by crystallizing the amorphous alloy ribbon piece 2A, the coercivity Hc and the magnetic-flux density Bs at each position of P1 to P4 in a planar direction illustrated in FIG. 7 were measured with a vibrating sample magnetometer (VSM). The results are indicated in Table 1. FIG. 8 is a graph indicating the coercivity Hc at each position in the planar direction of the alloy ribbon piece crystallized in the experiment on the method for manufacturing alloy ribbon piece of Example.

TABLE 1

| Position in Planar Direction | Coercivity Hc [A/m] | Magnetic-Flux Density Bs [T] |
|---|---|---|
| P1 | 9.22 | 1.759 |
| P2 | 9.58 | 1.777 |
| P3 | 7.25 | 1.748 |
| P4 | 6.61 | 1.770 |

As seen from the above-described Table 1 and FIG. 8, at any position in the planar direction of the crystallized alloy ribbon piece, the coercivity Hc was within a target range without exceeding the upper limit (10 A/m) of the target range. Furthermore, at any position in the planar direction of the crystallized alloy ribbon piece, the magnetic-flux density Bs had values exceeding 1.7 T, which was greater than that before the crystallization.

While the embodiment of the method for manufacturing alloy ribbon piece according to the present disclosure have been described in detail above, the present disclosure is not limited thereto, and can be subjected to various kinds of changes in design without departing from the spirit of the present disclosure described in the claims.

All publications, patents and patent applications cited in the present description are herein incorporated by reference as they are.

DESCRIPTION OF SYMBOLS

2A Amorphous alloy ribbon piece

2*s* One end in planar direction of amorphous alloy ribbon piece

2*e* Other end in planar direction of amorphous alloy ribbon piece

2*m* Intermediate position between one end and another end in planar direction of amorphous alloy ribbon piece GS High temperature gas source G High temperature gas

What is claimed is:

1. A method for manufacturing an alloy ribbon piece obtained by crystallizing an amorphous alloy ribbon piece, the method comprising:

preparing the amorphous alloy ribbon piece;

sequentially heating a whole region in the width direction of the amorphous alloy ribbon piece from one end to an intermediate position toward another end of the amorphous alloy ribbon piece to a temperature range equal to or more than a crystallization starting temperature, and stopping the heating when the heating of the whole region in the width direction of the amorphous alloy ribbon piece reaches the intermediate position of the amorphous alloy ribbon piece; and sequentially heating a whole region in the width direction of the amorphous alloy ribbon piece from the other end of the amorphous alloy ribbon piece to a position immediately before the intermediate position of the amorphous alloy ribbon piece to the temperature range equal to or more than the crystallization starting temperature, wherein the width direction is a direction perpendicular to a direction from the one end to the other end of the amorphous alloy ribbon piece, and wherein in the sequentially heating the whole region in the width direction of the amorphous alloy ribbon piece from the other end of the amorphous alloy ribbon piece, the whole region in the width direction of the amorphous alloy ribbon piece is heated up to the position immediately before the intermediate position of the amorphous alloy ribbon piece after the intermediate position of the amorphous alloy ribbon piece is cooled to a temperature range less than the crystallization starting temperature after the heating is stopped in the sequentially heating the whole region in the width direction of the amorphous alloy ribbon piece from the one end of the amorphous alloy ribbon piece.

2. The method for manufacturing an alloy ribbon piece according to claim 1, wherein a cross-sectional area on the one end side of the amorphous alloy ribbon piece is smaller than a cross-sectional area on the other end side thereof.

3. The method for manufacturing an alloy ribbon piece according to claim 1, wherein in the sequentially heating the whole region in the width direction of the amorphous alloy ribbon piece from the other end of the amorphous alloy ribbon piece, the whole region in the width direction of the amorphous alloy ribbon piece is heated up to the position immediately before the intermediate position of the amorphous alloy ribbon piece to the temperature range equal to or more than the crystallization starting temperature after an elapse of one second or more from the stopping of the heating in the sequentially heating the whole region in the width direction of the amorphous alloy ribbon piece from the one end of the amorphous alloy ribbon piece.

* * * * *